US009033058B2

(12) United States Patent
Ahmed et al.

(10) Patent No.: US 9,033,058 B2
(45) Date of Patent: May 19, 2015

(54) NO-GO TAG SYSTEMS AND METHODS FOR PROGRESSIVE CAVITY PUMPS

(75) Inventors: Tariq Ahmed, Lloydminster (CA); Denis J. Blaquiere, Lloydminster (CA)

(73) Assignee: NATIONAL OILWELL VARCO, L.P., Houston, TX (US)

( * ) Notice: Subject to any disclaimer, the term of this patent is extended or adjusted under 35 U.S.C. 154(b) by 771 days.

(21) Appl. No.: 13/375,572

(22) PCT Filed: Jun. 1, 2010

(86) PCT No.: PCT/US2010/036810

§ 371 (c)(1), (2), (4) Date: Apr. 2, 2012

(87) PCT Pub. No.: WO2010/141408

PCT Pub. Date: Dec. 9, 2010

(65) Prior Publication Data

US 2012/0181042 A1 Jul. 19, 2012

Related U.S. Application Data

(60) Provisional application No. 61/182,883, filed on Jun. 1, 2009, provisional application No. 61/251,953, filed on Oct. 15, 2009.

(51) Int. Cl.

| | |
|---|---|
| ***E21B 43/12*** | (2006.01) |
| ***F04C 2/107*** | (2006.01) |
| ***F04C 13/00*** | (2006.01) |

(52) U.S. Cl.

CPC ..... *E21B 43/126* (2013.01); *F04C 2/1075* (2013.01); *F04C 13/008* (2013.01); *F04C 2230/603* (2013.01)

(58) Field of Classification Search

USPC ..... 166/369, 68, 68.5, 105, 381, 382, 370, 166/341, 377, 378, 241.2

See application file for complete search history.

(56) References Cited

U.S. PATENT DOCUMENTS 1,938,255 A * 12/1933 Hinderliter ..... 285/106
4,592,427 A 6/1986 Morgan (Continued)

FOREIGN PATENT DOCUMENTS

CA 2310198 A1 11/2001
CA 2567989 A1 12/2005

(Continued)

OTHER PUBLICATIONS

PCT/US2010/036810 International Search Report and Written Opinion, Jan. 17, 2011 (10 p.).

(Continued)

*Primary Examiner* — David Andrews
*Assistant Examiner* — Ronald Runyan
(74) *Attorney, Agent, or Firm* — Conley Rose, P.C.

(57) ABSTRACT

A stator for a progressive cavity pump comprises a stator housing having a central axis, a first end, and a second end opposite the first end. In addition, the stator comprises a stator liner disposed within the stator housing. The stator liner has a first end and a second end opposite the first end. The first end of the stator liner is axially spaced from the first end of the stator housing. Further, the stator comprises a tag insert positioned in the stator housing between the first end of the stator housing and the first end of the stator liner. The tag insert has a through passage defining a radially inner surface that includes a tag shoulder.

19 Claims, 14 Drawing Sheets

(56) References Cited

U.S. PATENT DOCUMENTS

| | | | | |
|---|---|---|---|---|
| 5,209,294 | A * | 5/1993 | Weber | 166/105 |
| 5,725,053 | A * | 3/1998 | Weber | 166/105 |
| 6,338,388 | B1 * | 1/2002 | Winkler | 166/382 |
| 6,729,391 | B2 | 5/2004 | Hill et al. | |
| 7,201,222 | B2 | 4/2007 | Kanady et al. | |
| 2003/0111221 | A1 | 6/2003 | Hill et al. | |
| 2005/0263289 | A1 | 12/2005 | Kanady et al. | |
| 2009/0136371 | A1 | 5/2009 | Gerling | |

FOREIGN PATENT DOCUMENTS

| | | | |
|---|---|---|---|
| CA | 2612326 | A1 | 5/2009 |
| WO | 2005119006 | A1 | 12/2005 |

OTHER PUBLICATIONS

PCT/US2010/036810 Submission of Informal Comments to the Written Opinion of the International Searching Authority Dated Jan. 17, 2011; Response submitted Feb. 17, 2011 (4 p.).

* cited by examiner

NO-GO TAG SYSTEMS AND METHODS FOR PROGRESSIVE CAVITY PUMPS

CROSS REFERENCE TO RELATED APPLICATIONS

This application is a 35 U.S.C. §371 national stage application of PCT/US2010/036810 filed Jun. 1, 2010, which claims the benefit of U.S. Provisional Application No. 61/182,883 filed Jun. 1, 2009 and U.S. Provisional Application No. 61/251,953 filed Oct. 15, 2009, all of which are incorporated herein by reference in their entireties for all purposes.

STATEMENT REGARDING FEDERALLY SPONSORED RESEARCH OR DEVELOPMENT

Not applicable.

BACKGROUND

1. Field of the Invention

The invention relates generally to downhole tools. More particularly, the present invention relates to progressive cavity pumps. Still more particularly, the present invention relates to tag systems for positioning and locating the rotor relative to the stator of a progressive cavity pump.

2. Background of the Invention

A progressive cavity pump (PC pump), also know as a "Moineau" pump, transfers fluid by means of a sequence of discrete cavities that move through the pump as a rotor is turned within a stator. Transfer of fluid in this manner results in a volumetric flow rate proportional to the rotational speed of the rotor within the stator, as well as relatively low levels of shearing applied to the fluid. Consequently, progressive cavity pumps are typically used in fluid metering and pumping of viscous or shear sensitive fluids, particularly in downhole operations for the ultimate recovery of oil and gas. A PC pump may be used in reverse as a positive displacement motor (PD motor) to convert the hydraulic energy of a high pressure fluid into mechanical energy in the form of speed and torque output, which may be harnessed for a variety of applications, including downhole drilling.

As shown in FIGS. 1 and 2, a conventional PC pump 10 comprises a helical-shaped rotor 30, typically made of steel that may be chrome-plated or coated for wear and corrosion resistance, disposed within a stator 20, typically a heat-treated steel tube or housing 25 lined with a helical-shaped elastomeric insert 21. The helical-shaped rotor 30 defines a set of rotor lobes 37 that intermesh with a set of stator lobes 27 defined by the helical-shaped insert 21. As best shown in FIG. 2, the rotor 30 typically has one fewer lobe 37 than the stator 20. When the rotor 30 and the stator 20 are assembled, a series of cavities 40 are formed between the outer surface 33 of the rotor 30 and the inner surface 23 of the stator 20. Each cavity 40 is sealed from adjacent cavities 40 by seals formed along the contact lines between the rotor 30 and the stator 20. The central axis 38 of the rotor 30 is parallel to and radially offset from the central axis 28 of the stator 20 by a fixed value known as the "eccentricity" of the PC pump.

During operation of the PC pump 10, the application of torque to rotor 30 causes rotor 30 to rotate within stator 20, resulting in fluid flow through the length of PC pump 10. In particular, adjacent cavities 40 are opened and filled with fluid as rotor 30 rotates relative to stator 20. As this rotation and filling process repeats in a continuous manner, fluid flows progressively down the length of PC pump 10.

PC pumps are used extensively in the oil and gas industry for operating low pressure oil wells and also for raising water from wells. As shown in FIG. 3, PC pump 10 previously described disposed in a cased borehole 50 in a conventional manner to pump oil to the surface. Since PC pumps (e.g., PC pump 10) are often mounted tens or hundreds of meters below the surface, it is difficult to mount an electric drive motor to the PC pump. Consequently, as shown in FIG. 3, it has become common practice to secure the stator 20 on to the lower end of a string of production tubing 60. In particular, the upper threaded end of the stator housing 25 is axially connected end-to-end with the lower threaded end of the production tubing 60 with a mating threaded collar 65. Once the stator 20 is secured to the lower end of the production tubing 60, it is lowered into the cased borehole 50 on the tubing string 60. Thus, the production tubing 60 is used both to position stator 20 and PC pump 10 at a specific depth in the well bore, and to axially support the weight of the PC pump 10 and the weight of the fluid column extending between the PC pump 10 and the surface which bears against the upper end of stator liner 21.

Once the stator 20 is properly positioned at the desired depth for production, the upper end of the rotor 30 is threaded to the lower end of a sucker rod string 70 at the surface, lowered through the production tubing 60, and inserted into the stator liner 21. To operate PC pump 10 at the desired capacity, rotor 30 must be positioned at the proper axial position relative to stator 20. For example, if the lower end of rotor 30 does not extend to the lower end of stator liner 21, a portion of the lower end of the liner 21 will not be in engagement with rotor 30, and thus, pumping capacity may suffer. Thus, to properly position the rotor 30 within the stator 20, a tag-bar 80 is provided at the lower end of the stator 20. The tag-bar 80 extends across the lower portion of the stator 20, and thus, the rotor 30 is axially lower until the lower end of rotor 30 contacts the tag-bar 80. Once the lower end of the rotor 30 contacts tag-bar 80 and the weight of sucker rod string 70 has been supported by the tag-bar 80 as detected at the surface, the entire rod string 70 is lifted upward a predetermined distance to account for stretching of sucker rod string 70 and to properly position the entire rotor 30 within the stator 20. To begin pumping, a drivehead at the surface applies rotational torque to the rod string 70, which in turn causes downhole rotor 30 to rotate relative to the stator 20.

One disadvantage of the conventional approach employing the tag-bar 80 extending across the lower end of the stator 20 to position the rotor 30 within the stator 20 is that the tag-bar 80 creates an obstruction in the stator 20 and the production tubing 60. Consequently, tag-bar 80 prevents the lowering of tools and/or instruments axially below the stator 20.

Accordingly, there remains a need in the art for improved systems, devices, and methods for the downhole positioning PC pump rotors within PC pump stators. Such devices, methods, and systems would be particularly well received if capable of allowing the insertion of tools and instruments through the stator and into the portion of the wellbore below the stator.

BRIEF SUMMARY OF THE DISCLOSURE

These and other needs in the art are addressed in one embodiment by a progressive cavity pumping system for pumping a fluid from a wellbore. In an embodiment, the pumping system comprises a tubing string extending into the wellbore. In addition, the pumping system comprises a stator coupled to the tubing string. The stator has a central axis, an upper end, and a lower end opposite the upper end. The stator also includes a stator housing and a stator liner disposed within the stator housing. The stator liner extends along the central axis from a first end proximal the upper end of the stator housing and a second end distal the upper end of the stator housing, and the stator liner includes a helical passage extending from the first end of the stator liner to the second end of the stator liner. Further, the pumping system comprises a rod string extending through the tubing string. Still further, the pumping system comprises a helical rotor extending axially into the through passage of the stator liner. The rotor has a first end coupled to a lower end of the rod string and a second end distal the rod string. Moreover, the pumping system comprises a tag insert positioned in the stator housing between the upper end of the stator housing and the first end of the stator liner. The tag insert comprises a through passage including a tag shoulder. The rotor extends axially through the passage of the tag insert. The tag shoulder is adapted to restrict the first end of the rotor from passing axially into the stator liner.

These and other needs in the art are addressed in another embodiment by a method for pumping fluid from a wellbore to the surface. In an embodiment, the method comprises providing a stator comprising a stator housing and a stator liner disposed within the stator housing. The stator housing has a central axis, an upper end, and a lower end opposite the upper end, and the stator liner includes a helical through passage. In addition, the method comprises positioning a tag insert in the stator housing between the stator liner and the upper end of the stator housing. Further, the method comprises lowering the stator into a wellbore and lowering a rotor into a wellbore. Still further, the method comprises axially advancing the rotor through the tag insert and into the helical through passage of the stator liner downhole. Moreover, the method comprises a using the tag insert to properly position the rotor within the stator liner. In addition, the method comprises rotating the rotor within the stator liner with the rod string to pump a fluid to the surface.

These and other needs in the art are addressed in another embodiment by a stator for a progressive cavity pump. In an embodiment, the stator comprises a stator housing having a central axis, a first end, and a second end opposite the first end. In addition, the stator comprises a stator liner disposed within the stator housing. The stator liner has a first end and a second end opposite the first end. The first end of the stator liner is axially spaced from the first end of the stator housing. Further, the stator comprises a tag insert positioned in the stator housing between the first end of the stator housing and the first end of the stator liner. The tag insert has a through passage defining a radially inner surface that includes a tag shoulder.

Thus, embodiments described herein comprise a combination of features and advantages intended to address various shortcomings associated with certain prior devices, systems, and methods. The various characteristics described above, as well as other features, will be readily apparent to those skilled in the art upon reading the following detailed description, and by referring to the accompanying drawings.

BRIEF DESCRIPTION OF THE DRAWINGS

For a more detailed description of the embodiments, reference will now be made to the following accompanying drawings.

DETAILED DESCRIPTION OF SOME OF THE PREFERRED EMBODIMENTS

Figure 1:
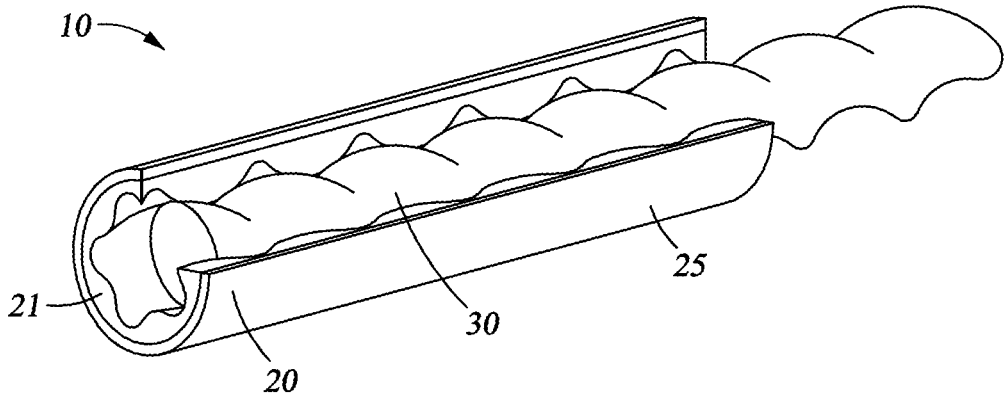
FIG. 1 is a perspective, partial cut-away view of a progressive cavity pump.
Figure 2:
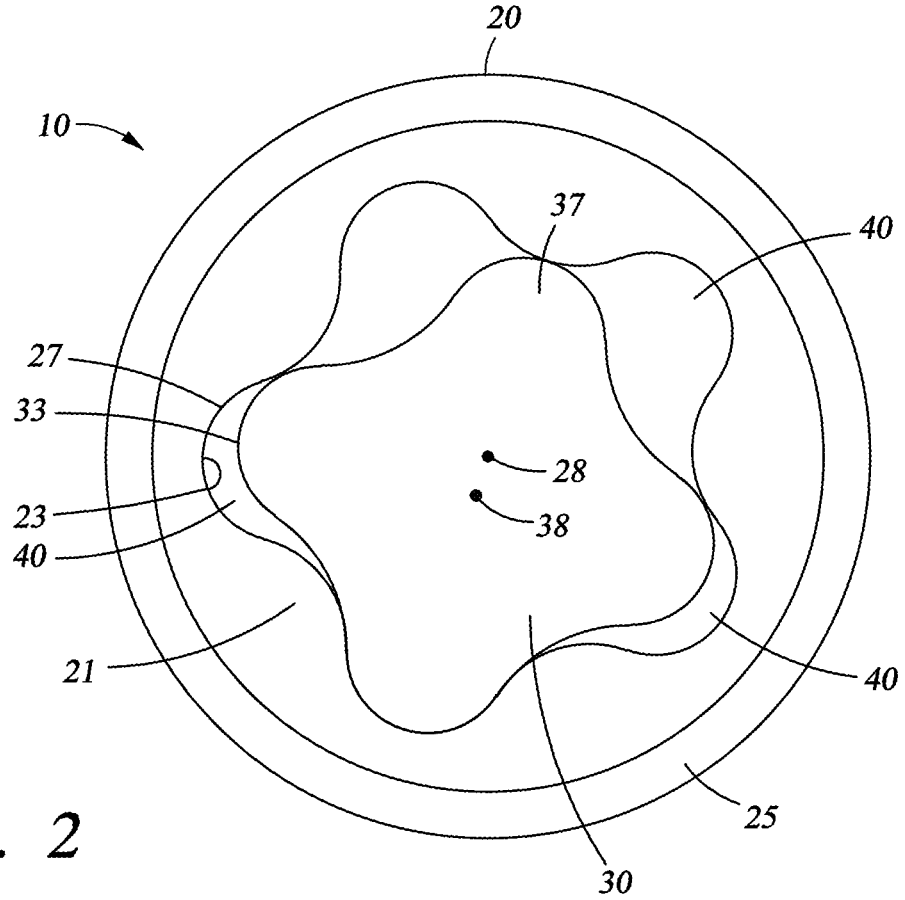
FIG. 2 is a cross-sectional end view of the progressive cavity pump of FIG. 1.
Figure 3:
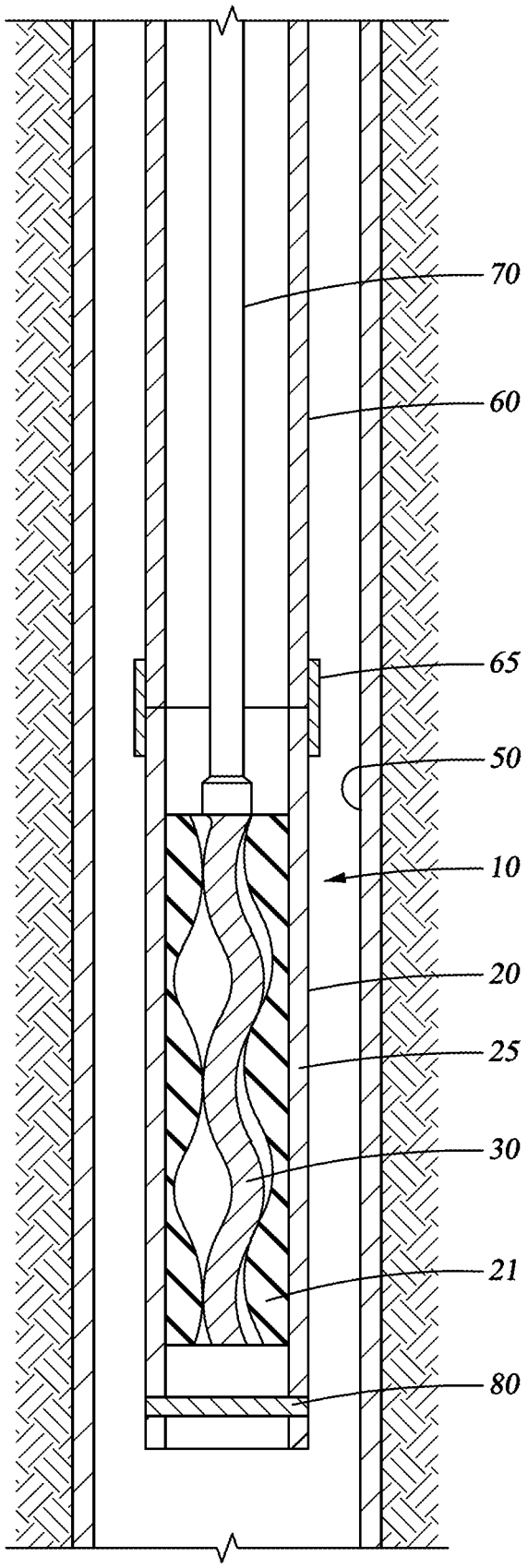
FIG. 3 is a cross-sectional view of the progressive cavity pump of FIG. 1 conventionally delivered downhole on the lower end of tubing string.

The following discussion is directed to various embodiments of the invention. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . . " Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis.

Figure 4:
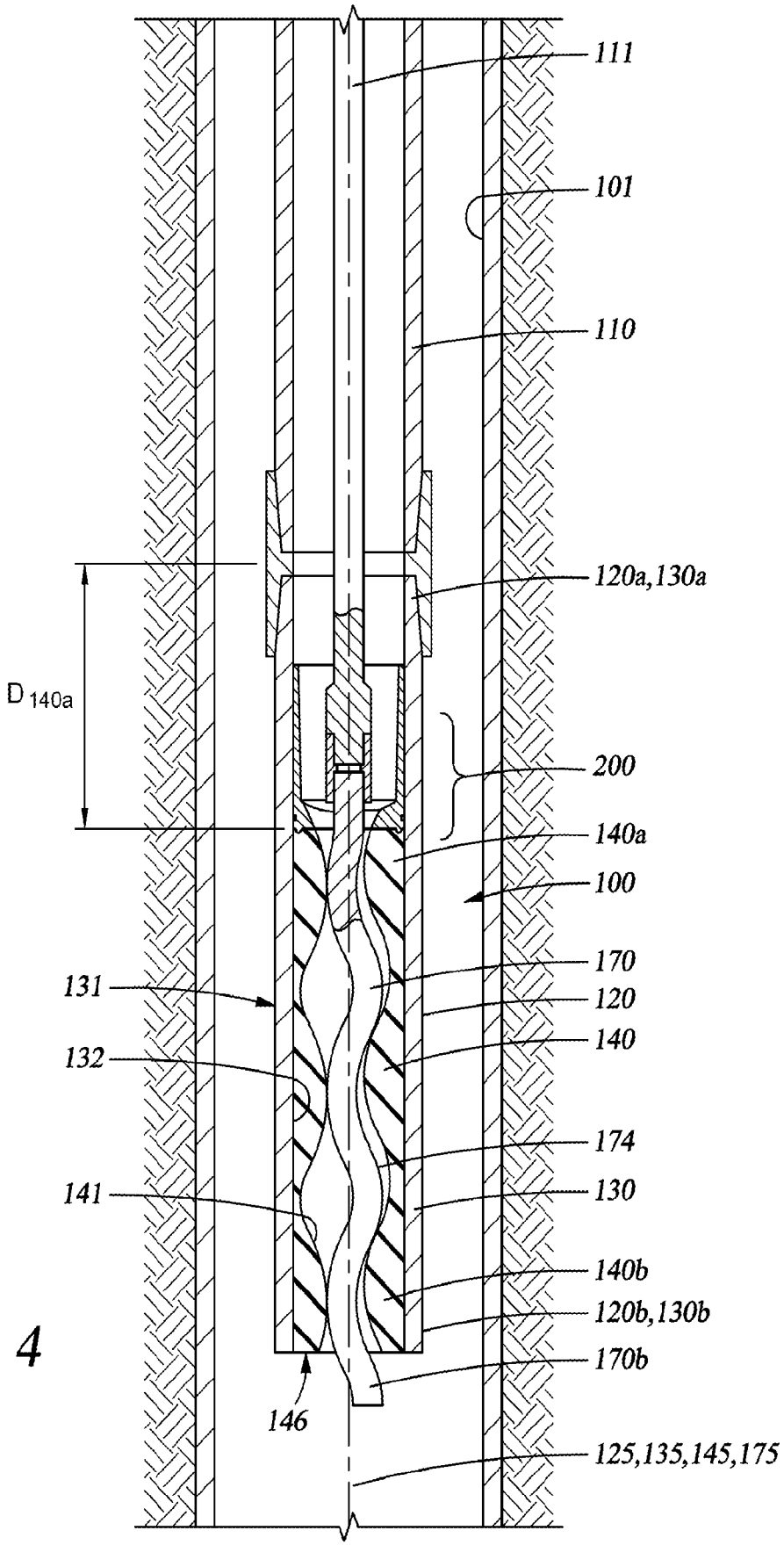
FIG. 4 is a cross-sectional view of an embodiment of a progressive cavity pump system in accordance with the principles described herein disposed in a cased wellbore.
Figure 5:
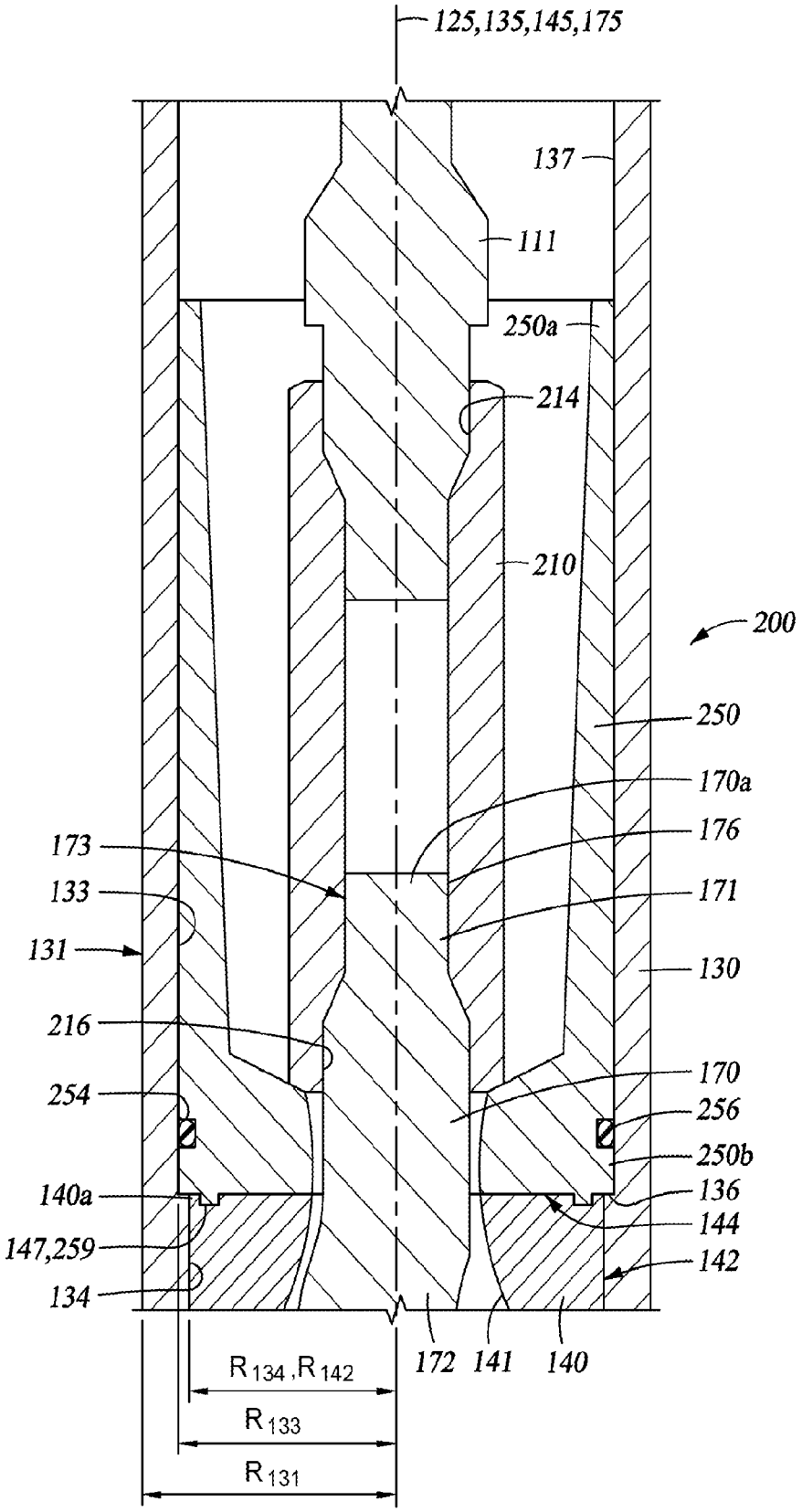
FIG. 5 is an enlarged cross-sectional view of the no-go tag assembly of FIG. 4.

Referring now to FIGS. 4 and 5, an embodiment of a progressive cavity or PC pump 100 for pumping a fluid (e.g., oil, water, etc.) from a cased wellbore 101 to the surface is shown. PC pump system 100 includes a stator 120, a rotor 170 disposed in stator 120, and a no-go tag assembly 200 for positioning rotor 170 within stator 120. As shown in FIG. 4, PC pump system 100 is positioned "downhole" at the lower end of a production tubing string 110 disposed in wellbore 101.

Stator 120 has a central or longitudinal axis 125, a first or upper end 120*a*, and a second or lower end 120*b* opposite upper end 120*a*. In addition, stator 120 comprises a tubular outer housing 130 and a stator liner 140 disposed within housing 130.

Stator housing 130 has a central or longitudinal axis 135, a first or upper end 130*a*, and a second or lower end 130*b* opposite upper end 130*a*. Housing axis 135 is coincident with stator axis 125, and housing ends 130*a, b* extend to stator ends 120*a, b*, respectively. Upper end 130*a* of housing 130 is connected end-to-end with the lower end of production tubing 110. In addition, stator 120 and stator housing 130 are coaxially aligned with production tubing 110.

As best shown in FIG. 5, stator housing 130 has a radially outer surface 131 and a radially inner surface 132, each surface 131, 132 extending axially between ends 130*a, b*. Outer surface 131 is a smooth cylindrical surface disposed at a uniform radius $R_{131}$. Inner surface 132 includes a first cylindrical section 133 disposed at a uniform radius $R_{133}$ and a second cylindrical section 134 disposed at a uniform radius $R_{134}$ that is less than radius $R_{133}$. Cylindrical sections 133, 134 intersect at an annular shoulder 136 positioned between ends 130*a, b*. Thus, first cylindrical section 133 extends axially from upper end 130*a* to annular shoulder 136, and second cylindrical section 134 extends from lower end 130*b* to annular shoulder 136. First cylindrical section 133 is defined by a counterbore 137 extending axially from upper end 130*a* to shoulder 136.

In general, the stator housing (e.g., stator housing 130) may comprise any suitable material(s) including, without limitation, metals and metal alloys (e.g., stainless steel, aluminum, etc.), non-metals (e.g., polymers), composite(s) (e.g., carbon fiber and epoxy composite), or combinations thereof. However, the stator housing preferably comprises a durable, corrosion resistant material suitable for the harsh downhole conditions such as heat-treated carbon steel alloy.

Referring again to FIGS. 4 and 5, stator liner 140 has a central or longitudinal axis 145, a first or upper end 140*a*, and a second or lower end 140*b* opposite upper end 140*a*. Liner axis 145 is coincident with stator axis 125, and thus, housing 130 and liner 140 are coaxially aligned. In this embodiment, liner lower end 140*b* extends to lower ends 120*b*, 130*b* of stator 120 and housing 130, respectively. However, liner upper end 140*a* does not extend to upper ends 120*a*, 130*a*. Rather, liner upper end 140*a* is axially spaced below upper ends 120*a*, 130*a* by an axial offset distance $D_{140a}$ measured axially between upper ends 120*a*, 130*a* of stator 120 and housing 130, respectively, and liner upper end 140*a*. Further, liner upper end 140*a* is disposed axially below annular shoulder 136 of stator housing 130.

Stator liner 140 also includes a through passage 141 extending axially between ends 140*a, b*, a radially outer surface 142 extending axially between ends 140*a, b*, and a radially inner surface 143 extending axially between ends 140*a, b*, and defining through passage 141. Inner surface 143 is a helical-shaped surface adapted to mate with rotor 170. Helical-shaped inner surface 143 defines a plurality of stator lobes. Outer surface 142 is a smooth cylindrical surface disposed at a uniform radius $R_{142}$ that is the same as radius $R_{134}$ of second cylindrical section 134. In particular, outer surface 142 statically engages housing inner surface 132 along second cylindrical section 134. For instance, an interference fit may be formed between liner 140 and the housing 130. In addition to, or as an alternative, liner 140 may be bonded to inner surface 132 of housing 130.

Stator liner 140 also has an upper end surface 144 extending radially between surfaces 142, 143 at upper end 140*a*, and a lower end surface 146 extending radially between surfaces 142, 143 at lower end 140*b*. In this embodiment, each end surface 144, 146 is planar and oriented in a plane perpendicular to axis 145. As best shown in FIG. 5, in this embodiment, upper end surface 144 includes an annular recess 147 radially positioned proximal outer surface 142.

In general, the stator liner (e.g., liner 140) may comprise any suitable materials including, without limitation, metals and metal alloys, non-metals, composites, or combinations thereof. However, the stator liner preferably comprises a durable, resilient material capable of sealingly engaging the rotor (e.g., rotor 170) such as an elastomer or synthetic rubber.

Although the inner surface 132 of the stator housing 130 and outer surface 142 of stator liner 140 are each shown and described as cylindrical, and stator liner 140 has a non-uniform radial thickness, thereby enabling the helical-shaped inner surface 143 and associated stator lobes, in other embodiments, the stator liner (e.g., liner 140) may have a uniform radial thickness, yet still include the helical-shaped inner surface defining the plurality of stator lobes. For example, the housing may include a non-cylindrical helical-shaped inner surface that engages a mating non-cylindrical helical-shaped outer surface of the liner.

Referring still to FIGS. 4 and 5, rotor 170 has a central or longitudinal axis 175, a first or upper end 170*a*, and a second or lower end 170*b* opposite upper end 170*a*. Rotor 170 may be described as having a first or linear segment 171 extending linearly along axis 175 from upper end 170*a*, and a second or helical segment 172 extending helically about axis 175 from lower end 170*b* to linear segment 171. First segment 171 is straight and has a generally cylindrical outer surface 173. Second segment 172 has a smooth, helical-shaped outer surface 174 adapted to mate with helical-shaped inner surface 143 of stator liner 140. In addition, second axial segment 172 defines a plurality of rotor lobes that mate and engage the stator lobes. In general, the stator liner (e.g., stator liner 140) may have any suitable number of stator lobes, and the rotor (e.g., rotor 170) may have any suitable number of rotor lobes. Typically, the number of rotor lobes is one less than the number of stator lobes.

At upper end 170*a*, outer surface 173 of first segment 171 includes external threads 176 for releasably coupling rotor 170 to the lower end of a rod string 111 extending through production tubing 110. In general, rod string 111 is used to deliver rotor 170 downhole, through production tubing 110, to stator 120. Specifically, rotor 170 is axially advanced through production tubing string 110 and inserted into stator 120 until it is sufficiently positioned in stator liner 140. As will be described in more detail below, in this embodiment, no-go tag assembly 200 and associated space out procedures are employed to properly position rotor 170 within stator liner 140 for efficient fluid pumping. Thus, in this embodiment, a conventional tag-bar is not disposed at lower end 120*b* of stator 120. With rotor 170 properly positioned in stator liner 140, rod string 111 is rotated at the surface with a drivehead to drive the rotation of rotor 170, thereby enabling PC pump system 100 to pump fluids through production tubing 110 to the surface.

Referring still to FIGS. 4 and 5, no-go tag assembly 200 is employed to axially position rotor 170 within stator liner 140. No-go tag assembly 200 comprises a rotor coupling 210 and a tag insert 250. Rotor coupling 210 is axially positioned between the lower end of rod string 111 and upper end 170*a* of rotor 170, and tag insert 250 is coaxially disposed in counterbore 137 of stator housing 130.

Figure 6:
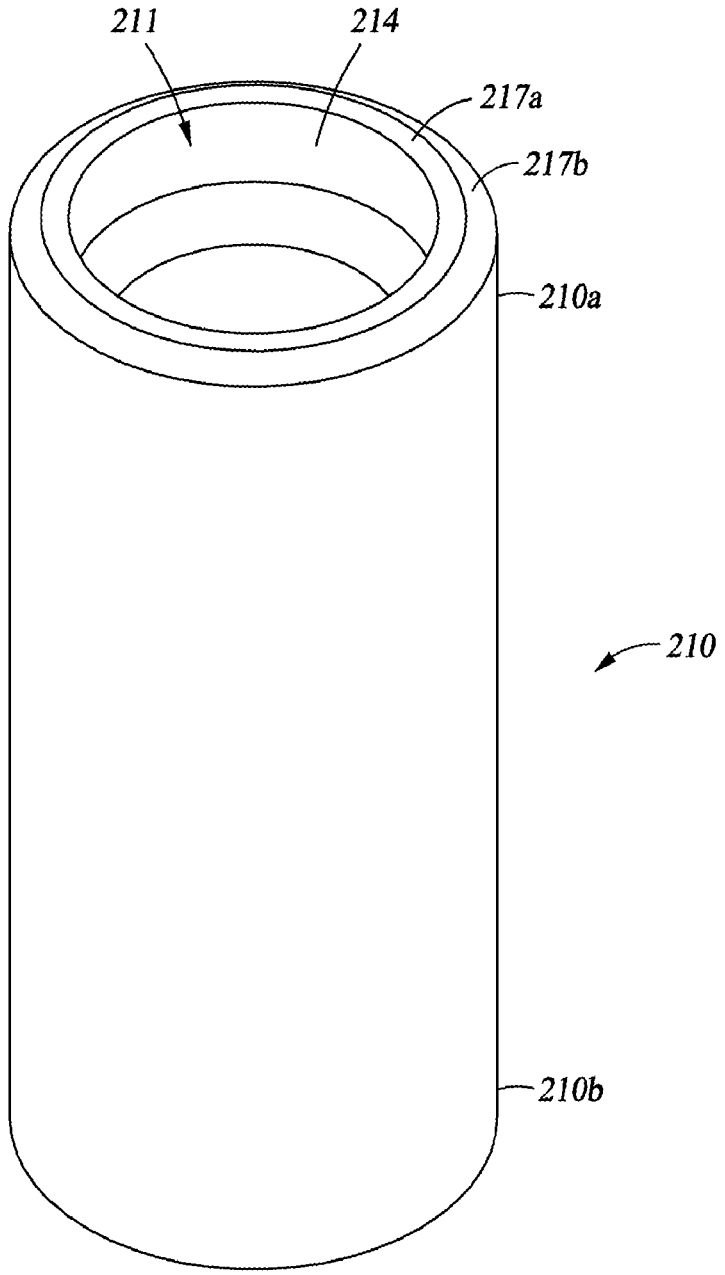
FIG. 6 is a perspective view of the rotor coupling of FIG. 5.
Figure 7:
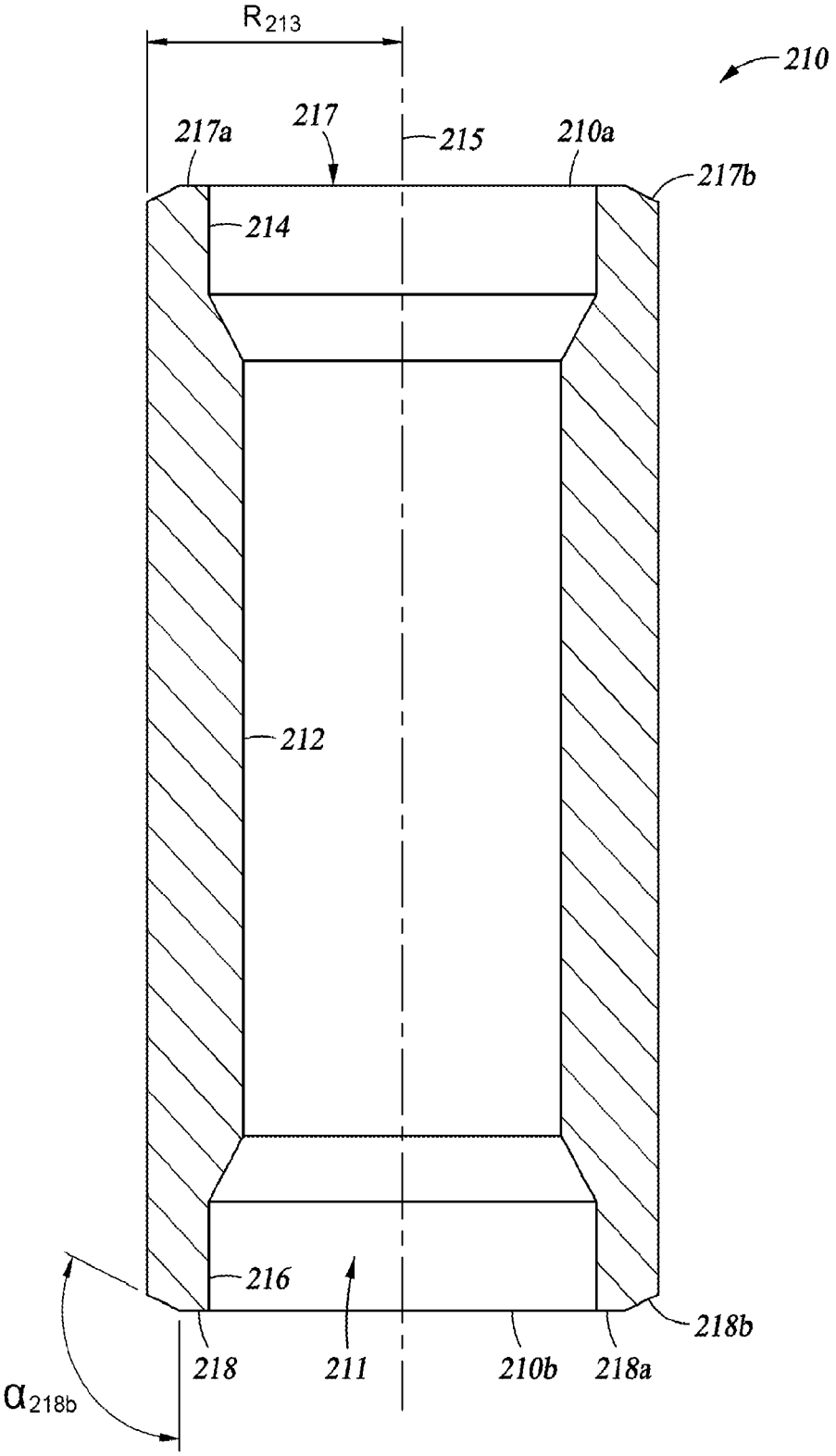
FIG. 7 is an enlarged cross-sectional view of the rotor coupling of FIG. 5.
Figure 8:
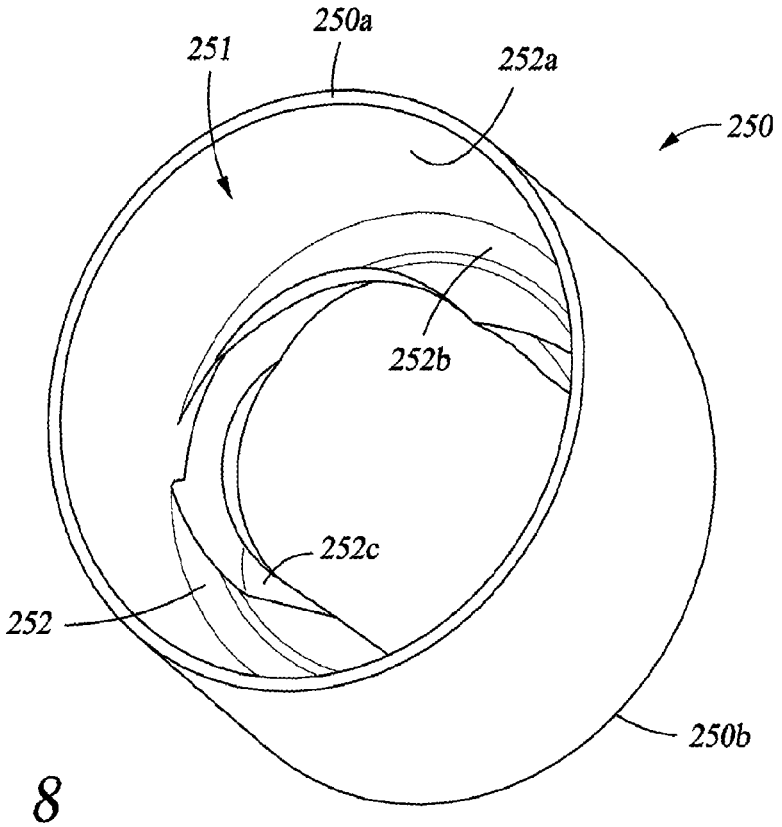
FIG. 8 is a perspective view of the tag insert of FIG. 5.
Figure 9:
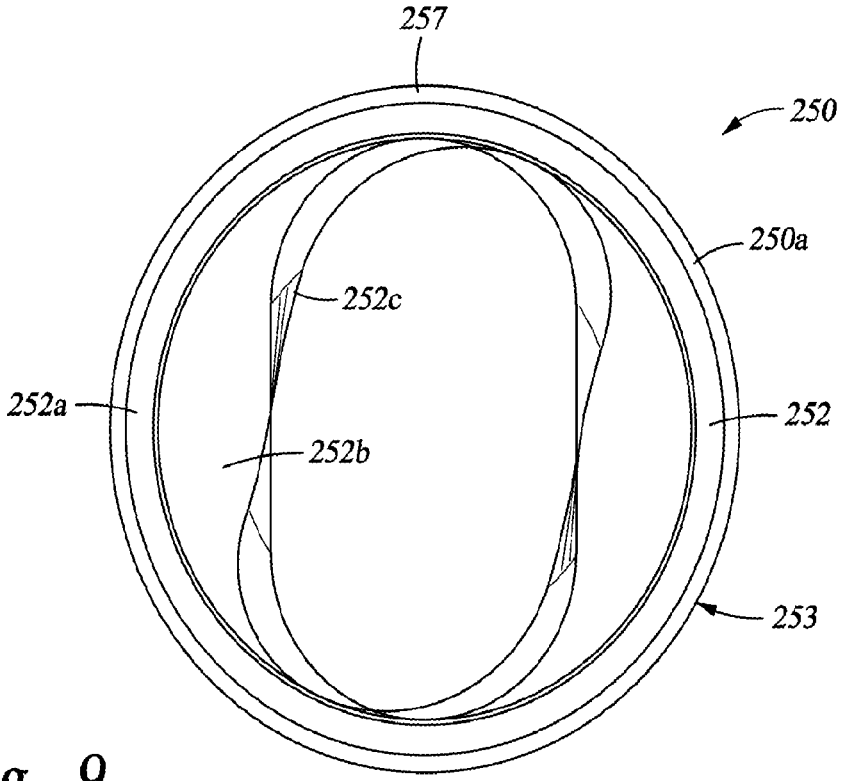
FIG. 9 is an end view of the tag insert of FIG. 5.
Figure 10:
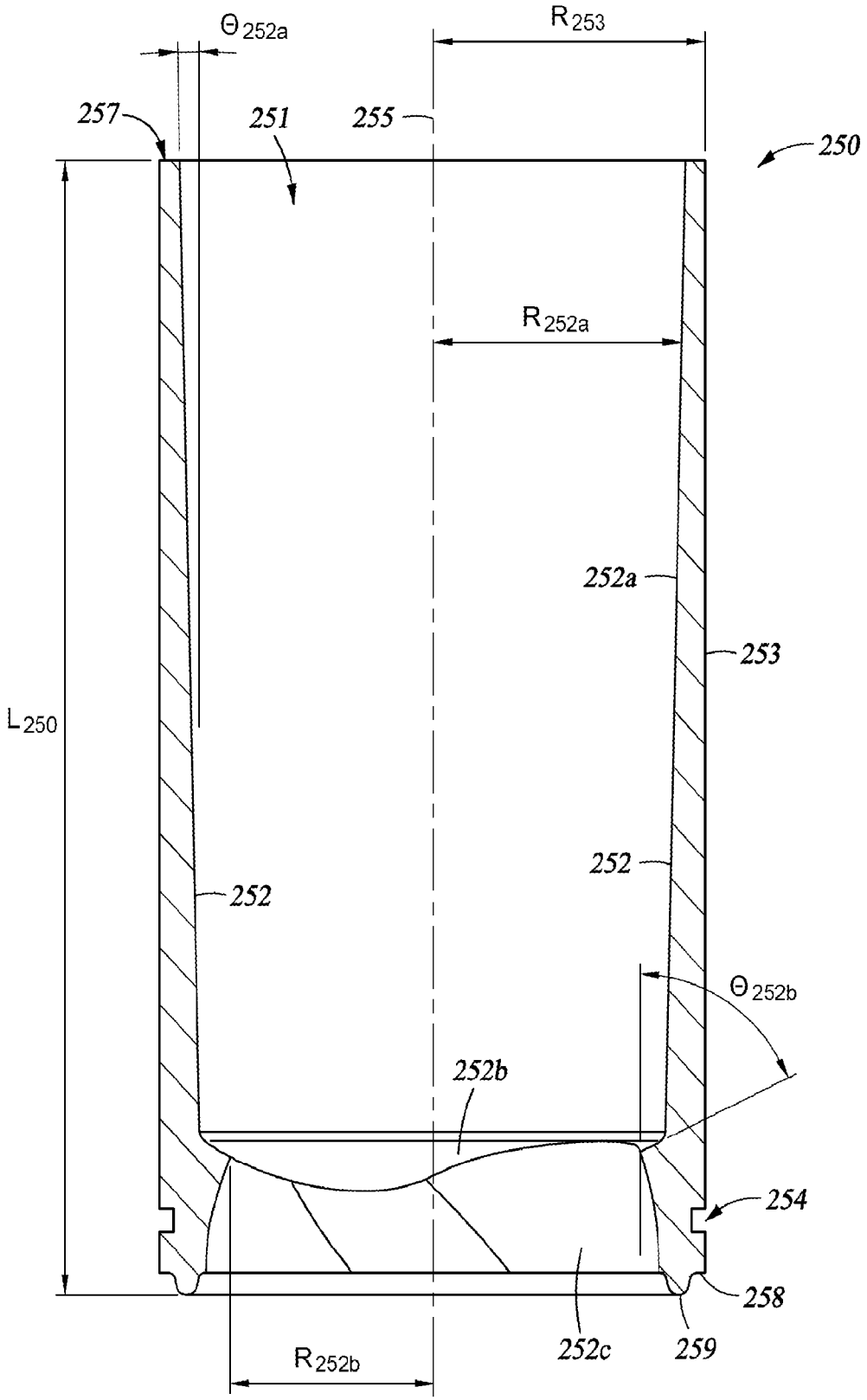
FIG. 10 is an enlarged cross-sectional view of the tag insert of FIG. 5.

Referring now to FIGS. 5-7, rotor coupling 210 has a central axis 215, a first or upper end 210*a*, and a second or lower end 210*b* opposite end 210*a*. When PC pump 100, including no-go tag assembly 200, is disposed downhole, central axis 215 is parallel to axes 125, 135, 175, but may be radially offset or spaced from axes 125, 135, 175 due to the eccentricity of PC pump 100.

In this embodiment, rotor coupling 210 includes a central through bore 211 extending between ends 210*a, b*, a radially inner surface 212 defined by through bore 211, and a radially outer surface 213. Outer surface 213 is a smooth cylindrical surface disposed at a uniform radius $R_{213}$. However, inner surface 212 is not disposed at a uniform radius between ends 210*a, b*. Rather, in this embodiment, through bore 211 comprises a first counterbore 214 extending axially from end 210*a* and a second counterbore 216 extending axially from end 210*b*. Counterbores 214, 216 releasably receive the lower end of rod string 111 and upper end 170*a* of rotor 170, respectively. In particular, counterbores 214, 216 include internal threads that threadingly engage mating external threads on the lower end of rod string 111 and external threads 176 on upper rotor end 170*a*, respectively. Although rotor coupling 210 is threadingly coupled to rod string 111 and rotor 170 in this embodiment, in general, the rotor coupling (e.g., rotor coupling 210) may be coupled to the rotor (e.g., rotor 170) and the rod string (e.g., rod string 111) in any suitable manner including, without limitation, welded connection, a pinned connection, an interference fit, bolts, or combinations thereof.

Referring still to FIGS. 5-7, rotor coupling 210 also includes end surfaces 217, 218 at ends 210*a, b*, respectively. End surface 217 extends radially from inner surface 212 and through bore 211 to outer surface 213 at end 210*a*, and end surface 218 extends radially from inner surface 212 and through bore 211 to outer surface 213 at end 210*b*. In this embodiment, each end surface 217, 218 includes a radially inner planar surface 217*a*, 218*a*, respectively, and a radially outer frustoconical surface 217*b*, 218*b*, respectively. Each radially inner end surface 217*a*, 218*a* is oriented in a plane perpendicular to axis 215 and extends radially from inner surface 212 to frustoconical surface 217*b*, 218*b*, respectively. Further, radially outer end surface 217*b*, 218*b* is oriented at an acute angle relative to axis 215 and extends radially from radially inner end surface 217*a*, 218*a*, respectively, to outer surface 213. In particular, frustoconical surface 218*b* at lower end 210*b* is oriented at an angle $\alpha_{218b}$ relative to axis 215.

As best shown in FIG. 5, counterbore 214 of rotor coupling 210 receives the lower end of rod string 111 and counterbore 216 of rotor coupling 210 receives upper end 170*a* of rotor 170. In particular, rotor coupling 210 extends axially over a portion of linear segment 171 of rotor 170. Accordingly, rotor coupling 210 may also be described as a "sleeve." When disposed about upper linear segment 171, rotor coupling 210 effectively increases the outer radius of upper end 170*a* and linear segment 171 to radius $R_{213}$.

In general, the purpose of the rotor coupling (e.g., rotor coupling 210) is to increase the effective outer radius of the upper end of the rotor (e.g., rotor 170). In this embodiment, rotor coupling 210 is disposed about upper end 170*a* of rotor 170 to effectively increase the outer radius of upper end 170*a* to radius $R_{213}$. However, in other embodiments, the rotor may be manufactured as a single piece including an integral or monolithic head having an increased outer radius, thereby eliminating the need for a separate rotor coupling or sleeve.

Referring now to FIGS. 5 and 8-10, tag insert 250 has a central axis 255, a first or upper end 250*a*, and a second or lower end 250*b* opposite end 250*a*. As best shown in FIG. 4, tag insert 250 is coaxially disposed in counterbore 137 of stator housing 130. Thus, when PC pump 100, including no-go tag assembly 200, is disposed downhole, central axis 255 is coaxially aligned and coincident with axes 125, 135, 175 previously described. Tag insert 250 has a length $L_{250}$ measured axially between ends 250*a, b*.

In this embodiment, tag insert 250 includes a central through passage 251 extending between ends 250*a, b*, a radially inner surface 252 defined by through passage 251, and a radially outer surface 253. Outer surface 253 includes an annular seal gland or groove 254 proximal lower end 250*b*. An annular seal element 256 is disposed in seal gland 254. Other than seal gland 254, outer surface 253 is a smooth cylindrical surface disposed at a uniform radius $R_{253}$ that is the same or slightly less than inner radius $R_{133}$ of counterbore 137. Thus, as best shown in FIG. 5, upon assembly of PC pump 100, outer surface 253 slidingly engages inner surface 133 of counterbore 137 and first cylindrical section 133. Seal element 256 is radially positioned between tag insert 250 and stator housing 130, and sealingly engages tag insert 250 and stator housing 130, thereby forming a radially inner static annular seal with tag insert 150 and a radially outer static annular seal with stator housing 130. Such seals restrict and/or prevent the axial flow of fluids between surfaces 132, 253.

Inner surface 252 may be divided into three distinct sections or surfaces—a first or upper inner surface 252*a* extending axially from upper end 250*a*, a second or intermediate inner surface 252*b* extending axially from upper inner surface 252*a*, and a third or lower inner surface 252*c* extending axially from lower end 250*b* to intermediate inner surface 252*b*. Thus, intermediate inner surface 252*b* is axially disposed between upper inner surface 252*a* and lower inner surface 252*c*. Inner surfaces 252*a, b, c* have different geometries. In this embodiment, upper inner surface 252*a* comprises a frustoconical surface disposed at an acute angle $\theta_{252a}$ relative to axis 255, intermediate inner surface 252*b* comprises a frustoconical surface disposed at an acute angle $\theta_{252b}$ relative to axis 255 that is greater than angle $\theta_{252a}$, and lower inner surface 252*c* is helical-shaped surface. Upper inner surface 252*a* is disposed at a radius $R_{252a}$ that decreases moving axially downward from upper end 250*a* to intermediate inner surface 252*b*, and intermediate inner surface 252*b* is disposed at a radius $R_{252b}$ that decreases moving axially downward from upper inner surface 252*a* to lower inner surface 252*c*. In this embodiment, angle $\theta_{252b}$ of upper intermediate surface 252*b* is the same as angle $\alpha_{218b}$ of lower end surface 218*b* of rotor coupling 210. Thus, in this embodiment, when lower end 210*b* of rotor coupling 210 engages intermediate inner surface 252*b* of tag insert 250, mating frustoconical surfaces 218*b*, 252*b* are substantially flush with each other. As will be described in more detail below, intermediate inner surface 252*b* defines a tag shoulder that rotor coupling 210 contacts during insertion of rotor 170 into stator liner 140. Consequently, intermediate inner surface 252*b* may also be referred to as a "tag shoulder."

Referring still to FIGS. 5 and 8-10, tag insert 250 has an upper end surface 257 extending radially between inner surface 252 and outer surface 253 at upper end 250*a*, and a lower end surface 258 extending radially between inner surface 252 and outer surface 253 at lower end 250*b*. In this embodiment, upper end surface 257 is planar and oriented in a plane perpendicular to axis 255. Further, in this embodiment, lower end surface 258 includes an axially extending annular ridge 259 proximal outer surface 253. As best shown in FIG. 5, annular ridge 259 is sized, shaped, and configured to mate and engage with annular recess 147 in upper end surface 144 of stator liner 140.

Referring again to FIG. 5, as previously described, tag insert 250 is coaxially disposed in counterbore 137. In particular, tag insert 250 is coaxially aligned with counterbore 137 and axially advanced through counterbore 137 until lower end surface 258 axially abuts annular shoulder 136 and ridge 259 is seated in recess 147. Thus, counterbore 137 and tag insert 250 are sized and configured such that lower end surface 258 axially abuts annular shoulder 136 simultaneous with engagement of ridge 259 and recess 147. Sufficient engagement between recess 147 and ridge 259 forms a seal between upper end 140*a* of stator liner 140 and lower end 250*b* of tag insert 250 and defines a more tortuous path for radial flow of fluids between stator liner 140 and tag insert 250, thereby restricting and/or preventing radial fluid flow between stator liner 140 and tag insert 250. In this embodiment, length $L_{250}$ of tag insert 250 is less than offset distance offset distance $D_{140a}$, and thus, tag insert 250 is completely disposed in counterbore 137 when lower end surface 258 of tag insert 250 axially abuts annular shoulder 136 of stator housing 130.

It should also be appreciated that simultaneous with the engagement of lower end surface 258 and annular shoulder 136 and engagement of ridge 259 and recess 147, lower end surface 258 contacts upper end surface 144 of stator liner 140. Engagement of end surfaces 143, 258 enables the smooth and continuous transition from helical-shaped inner surface 143 of stator liner 140 to the helical-shaped lower inner surface 252*c* of tag insert 250. Helical-shaped lower inner surface 252*c* is preferably timed to the helical-shaped inner surface 143 to effectively create a single, continuous helical shaped surface extending axially from lower end 140*b* of stator liner 140 through lower inner surface 252*c* to intermediate inner surface 252*b*.

Referring again to FIGS. 4 and 5, to assembly PC pump 100, lower end 250*b* of tag insert 250 is inserted into counterbore 137 at upper end 130*a* of stator housing 130 and axially advanced until lower end surface 258 axially abuts annular shoulder 136 and ridge 259 is seated in recess 147 as previously described. Next, upper end 130*a* of stator housing 130 is coupled to the lower end of production tubing 110. Production tubing 110 and stator 120 hung from the lower end of production tubing 110, are then axially inserted and advanced downhole through the cased wellbore 101 until stator 120 is disposed at the desired depth.

To position rotor 170 within stator 120 downhole, upper end 170*a* of rotor 170 is threaded into lower counterbore 216 of rotor coupling 210 and the lower end of rod string 111 is threaded into upper counterbore 214 of rotor coupling 210, thereby coupling rotor 170 to rod string 111. Rod string 111 and rotor 170 are then axially inserted and advanced downhole through production tubing 110 to stator 120. Lower end 170*b* of rotor 170 is axially inserted into counterbore 137 at upper end 130*a* of stator housing 130 and axially advanced through counterbore 137 and through passage 251 of tag insert 250 disposed within counterbore 137. As rotor 170 is advanced through tag insert 250, frustoconical inner surfaces 252*a, b* generally taper inward to guide and funnel lower end 170*b* of rotor 170 toward the center of passage 251 as it approaches lower inner surface 252*c* and stator liner 140. As will be described in more detail below, inner surfaces 252*a, b, c* are sized and configured to allow rotor 170 to be rotated therein and pass therethrough into passage 141 of stator liner 140.

Due to the helical-shaped outer surface 174 of second segment 172 and helical-shaped passage 141 of stator liner 140, a path or trajectory for rotor 170 is defined by passage 141 and inner surface 143. Rotor 170 may be rotated by rod string 111 as it is axially advanced into and through passage 141 to "thread" rotor 170 into passage 141 along the trajectory, rotor 170 is rotated by rod string 111. In some cases, depending primarily on the geometry and interference of the rotor (e.g., rotor 170) and the stator liner (e.g., stator liner 140), the rotor may be axially advanced through the stator liner without being rotated.

The clearance between rotor 170 and tag insert 250 generally decreases moving axially downward from upper end 250*a* to lower end 250*b*. However, lower inner surface 252*c* is sized and configured to be slightly larger than the outermost profile of helical surface 174 of rotor 170 as rotor 170 is rotated relative to tag insert 250 (e.g., during installation and/or pumping operations). Although helical surface 174 may periodically slidingly contact lower inner surface 252*c* of tag insert 252, lower inner surface 252*c* is preferably designed such that contact with rotor helical surface 174 is minimal as rotor 170 rotates relative to stator 120 and tag insert 250 during pumping operations.

As previously described, lower inner surface 252*c* is helically-shaped and timed to inner surface 143 of stator liner 140 such that inner surface 252*c* mates with helical-shaped outer surface 174 of rotor second segment 172 as rotor 170 rotates relative to stator 120 and tag insert 250 during installation and pumping operations. Accordingly, periodic sliding rotational engagement of lower inner surface 252*c* and helical-shaped outer surface 174 does not interfere or otherwise affect the rotation of rotor 170.

Depending on the application, a particular sized stator may be configured for use with rotors having different helical geometries (e.g., two, three, or four lobed geometries). Consequently, embodiments of tag inserts described herein (e.g., tag insert 250) are preferably configured for use with multiple rotor helical-geometries. For example, in the embodiment of tag insert 250 shown in FIGS. 8-10, lower helical surface 252*c* is configured (e.g., machined) to allow different rotor helical geometries (e.g., two, three, or four lobed geometries) to pass therethrough and rotate therewithin.

As previously described, through passage 251 of tag insert 250 is sized and configured to allow rotor 170 rotate therewithin and pass therethrough. Further, upper inner surface 252*a* of tag insert 250 is sized and configured to allow rotor coupling 210 to pass therethrough. In particular, the minimum radius $R_{252a}$ of upper inner surface 252*a* is greater than outer radius $R_{213}$ of rotor coupling 210. However, intermediate inner surface 252*b* defining the tag shoulder is sized and configured to prevent rotor coupling 210 from passing therethrough. In particular, the minimum radius $R_{252b}$ of intermediate inner surface 252*b* is less than the outer radius $R_{213}$ of rotor coupling 210. Thus, rotor 170 and rotor coupling 210 are axially advanced through tag insert 250 and stator liner 140 with rod string 111 until lower end 210*b* of rotor coupling 210 axially abuts intermediate inner surface 252*b* of tag insert 250. The engagement of rotor coupling 210 and intermediate inner surface 252*b* is detected at the surface by a sudden decrease in the weight of the rod string 111. At this point, lower end 170*b* of rotor 170 extends axially below stator 120 and stator liner 140, respectively. In other words, the portion of rotor 170 extending axially from rotor coupling 210 has an axial length that is greater than the axial distance between intermediate inner surface 252*b* and lower ends 120*b*, 140*b*. It should be appreciated that elimination of the conventional tag bar at the lower end of the stator (e.g., stator 120) enables rotor 170 to extend axially below stator 120.

Once rotor coupling 210 contacts intermediate inner surface 252*b*, rod string 111, including rotor 170 coupled thereto, is lifted axially upward a predetermined distance to account for stretching of sucker rod string 111, to prevent contact and interference between rotor coupling 210 and tag insert 250 during subsequent pumping operations, and to properly position rotor 170 within stator liner 140. In this embodiment, rotor coupling 210 is axially positioned above tag insert 250 when rotor 170 is properly positioned within stator liner 140 for pumping operation.

When properly positioned, rotor 170 will engage stator liner 140 along the entire axial length of stator liner 140 without engaging tag insert 250. To begin pumping, a drivehead at the surface applies rotational torque to rod string 111, which in turn causes downhole rotor 170 to rotate relative to stator 120 and tag insert 250. During pumping operations, tag insert 250 is static relative to stator 120. In particular, engagement of surfaces 132, 153, engagement of seal element 256 with gland 254 and surface 132, engagement recess 147 and ridge 259, and engagement of end surfaces 144, 258 restrict and/or prevent translational and motivational movement of tag insert 250 relative to stator 120 during downhole operations.

As previously described, for pumping operations, rotor 170 engages stator liner 140 along the entire axial length of stator liner 140 without engaging tag insert 250. Further, in this embodiment, rotor 170 is sized such that lower end 170*b* of rotor 170 extends axially below lower end 140*b* of stator liner 140 during pumping operations. In particular, since the conventional tag bar at the lower end of the stator (e.g., stator 120) is eliminated in embodiments described herein, rotor 170 can extend through and below stator liner 140. Positioning lower end 170*b* of rotor 170 below stator liner 140 allows rotor 170 to agitate and mixes the pumped fluid at the lower intake of pump 100, thereby offering the potential to maintain solids in suspension during pumping operations.

Figure 11:
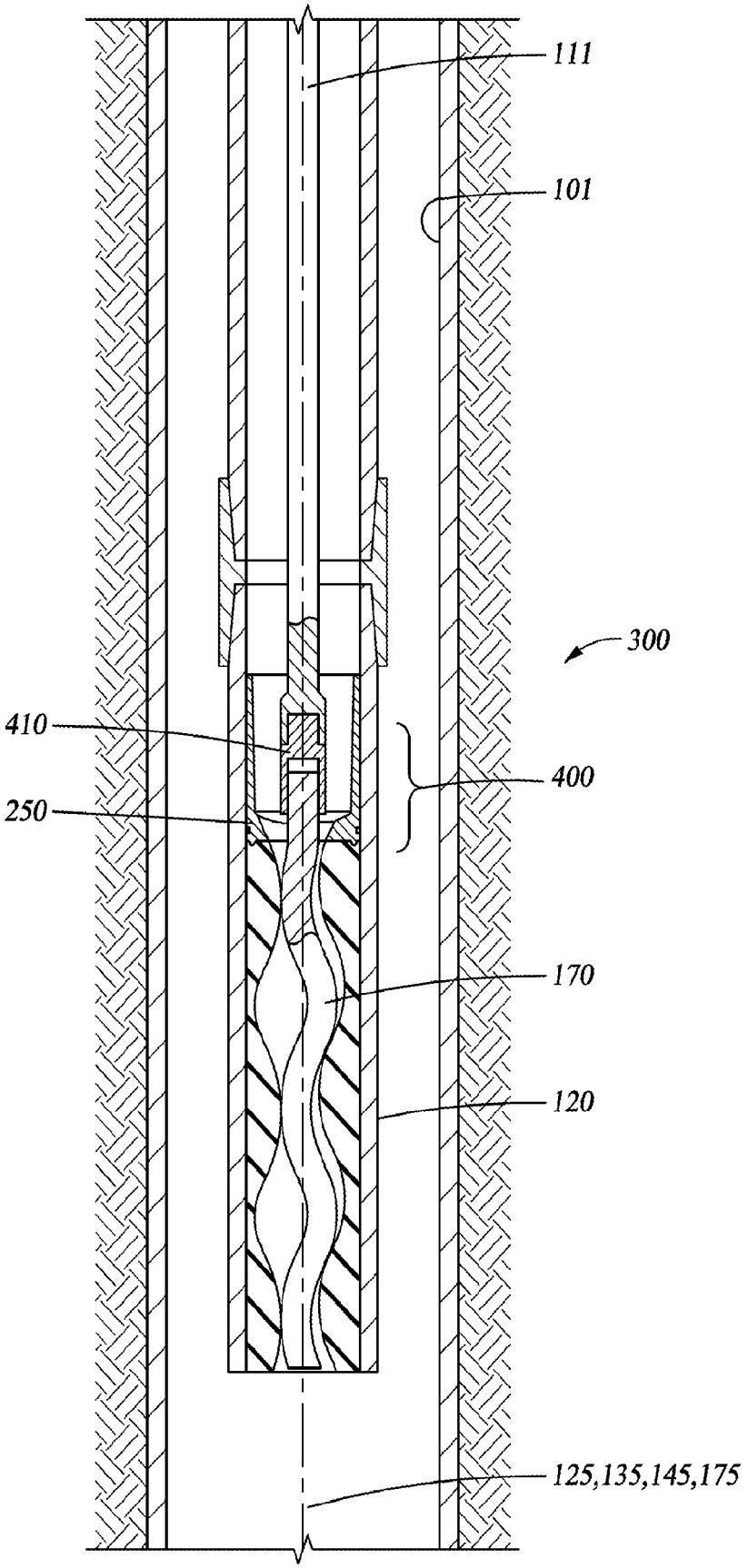
FIG. 11 is a cross-sectional view of an embodiment of a progressive cavity pump system in accordance with the principles described herein.

Referring now to FIG. 11, another embodiment of a PC pump 300 for pumping a fluid (e.g., oil, water, etc.) from cased wellbore 101 to the surface is shown. PC pump system 300 is substantially the same as PC pump 100 previously described. Namely, PC pump system 300 includes stator 120 and rotor 170 previously described. In addition, PC pump system 300 includes a no-go tag assembly 400 for positioning rotor 170 within stator 120. No-go tag assembly 400 includes tag insert 250 as previously described, however, in this embodiment, rotor coupling 210 has been replaced by a different rotor coupling 410.

Figure 12:
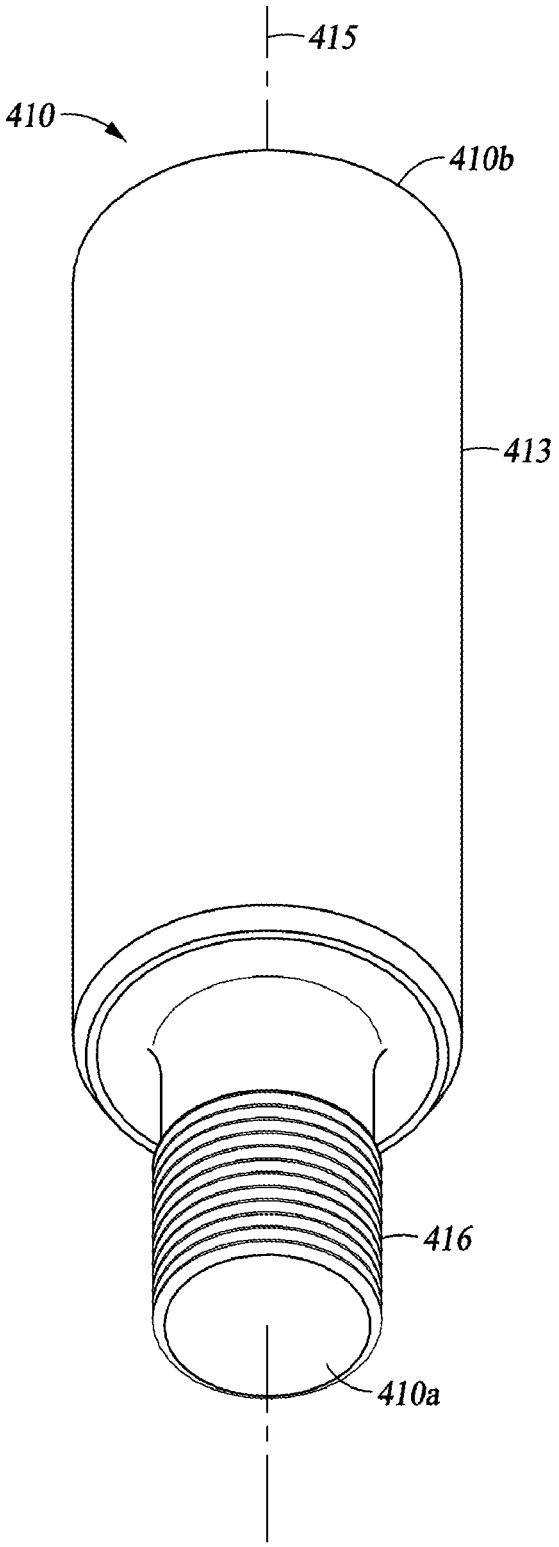
FIG. 12 is a perspective view of the rotor coupling of FIG. 11.
Figure 13:
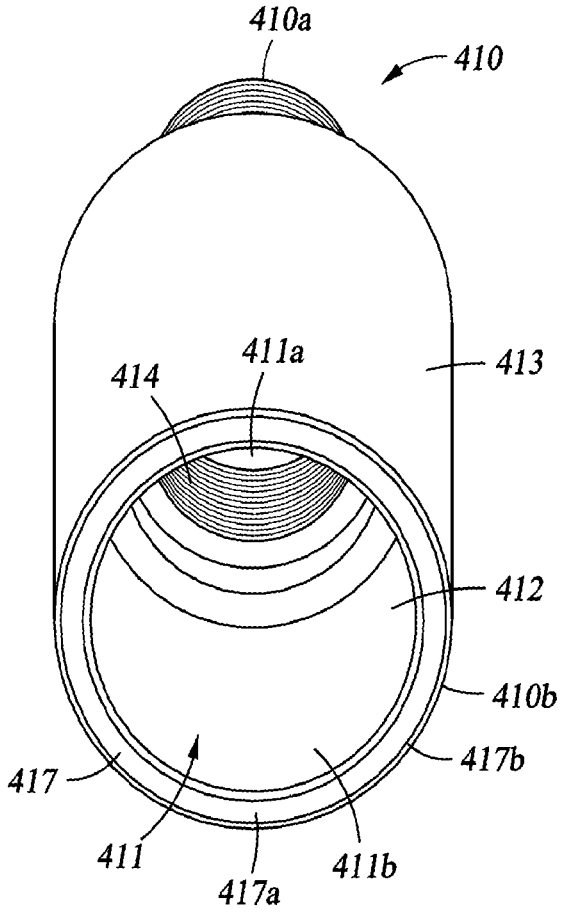
FIG. 13 is a perspective end view of the rotor coupling of FIG. 11.
Figure 14:
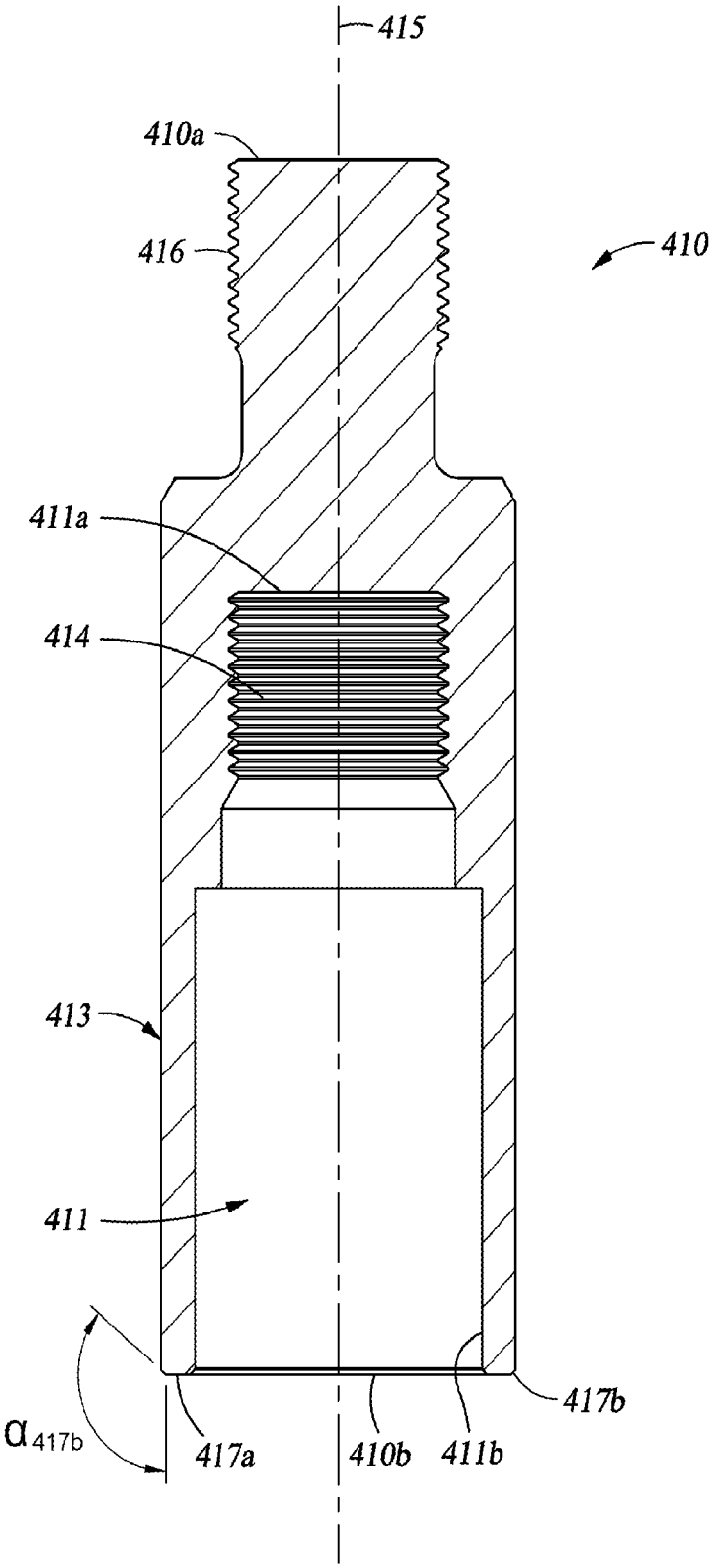
FIG. 14 is a cross-sectional view of the rotor coupling of FIG. 11.

Referring now to FIG. 12-14, rotor coupling 410 has a central axis 415, a first or upper end 410*a*, and a second or lower end 410*b* opposite end 410*a*. When deployed downhole in conjunction with stator 120, rotor 170, and tag insert 250, central axis 415 is parallel to axes 125, 135, 175, but may be radially offset or spaced from axes 125, 135, 175 due to eccentricity.

Referring still to FIGS. 12-14, in this embodiment, rotor coupling 410 includes a counterbore 411 extending axially from lower end 210*b*. Counterbore 411 has a first or upper end 411*a* disposed within coupling 410, a second or lower end 411*b* at coupling lower end 410*b*, and defines a cylindrical coupling inner surface 412. Rotor coupling 410 has a radially outer cylindrical surface 413 disposed at a uniform radius $R_{413}$.

Rotor coupling 410 is releasably coupled to the lower end of rod string 111 and upper end 170*a* of rotor 170. In particular, counterbore 411 includes internal threads 414 at upper end 411*a* that threadingly engage mating external threads 176 on upper rotor end 170*a*. In other words, counterbore 411 receives first segment 171 of rotor 170 and is threaded onto upper end 170*a* of rotor 170. Further, upper end 410*a* of rotor coupling 410 comprises external threads 416 that threadingly engaging mating internal threads on the lower end of rod string 111.

Referring still to FIGS. 12-14, rotor coupling 410 also includes a lower end surfaces 417 at lower end 410*b*. End surface 417 extends radially from counterbore 411 to outer surface 413 and includes a radially inner planar surface 417*a* and a radially outer frustoconical surface 417*b*. Radially inner end surface 417*a* is oriented in a plane perpendicular to axis 415 and extends radially from counterbore 411 to frustoconical surface 417*b*. Further, radially outer end surface 417*b* is oriented at an angle $\alpha_{417b}$ relative to axis 415 and extends radially from radially inner end surface 417*a* to outer surface 413.

As best shown in FIG. 11, counterbore 411 of rotor coupling 410 receives upper end 170*a* of rotor 170. In particular, rotor coupling 410 extends axially over a portion of linear segment 171 of rotor 170. Accordingly, rotor coupling 410 may also be described as a "sleeve." When disposed about upper linear segment 171, rotor coupling 410 effectively increases the outer radius of upper end 170*a* and linear segment 171 to radius $R_{413}$.

Referring still to FIG. 11, to assembly PC pump 300, tag insert 250 is disposed within counterbore 137, stator housing 130 is coupled to the lower end of production tubing 110, and stator 120 is disposed downhole to the desired depth with production tubing 110 as previously described. To position rotor 170 within stator 120 downhole, upper end 170*a* of rotor 170 is threaded into counterbore 411 of rotor coupling 410, and upper end 410*a* of rotor coupling 410 is threaded into the lower end of rod string 111, thereby coupling rotor 170 to rod string 111. Rod string 111 and rotor 170 are then axially inserted and advanced downhole through production tubing 110 to stator 120. Lower end 170*b* of rotor 170 is axially inserted into counterbore 137 at upper end 130*a* of stator housing 130 and axially advanced through counterbore 137, through passage 251 of tag insert 250, and helical stator passage 141 as previously described. Through passage 251 of tag insert 250 is sized and configured to allow rotor 170 rotate therewithin and pass therethrough. However, intermediate inner surface 252*b* is sized and configured to prevent rotor coupling 410 from passing therethrough. In particular, the minimum radius $R_{252b}$ of intermediate inner surface 252*b* is less than the outer radius $R_{413}$ of rotor coupling 410. Thus, rotor 170 and rotor coupling 410 are axially advanced through tag insert 250 and stator liner 140 with rod string 111 until lower end 410*b* of rotor coupling 410 axially abuts intermediate inner surface 252*b* of tag insert 250. The engagement of rotor coupling 410 and intermediate inner surface 252*b* is detected at the surface by a sudden decrease in the weight of the rod string 111. Next, rod string 111, including rotor 170 coupled thereto, is lifted axially upward a predetermined distance to account for stretching of sucker rod string 111, to prevent contact and interference between tag insert 250 and rotor coupling 410 during rotation of rotor 170, and to properly position rotor 170 within stator liner 140. To begin pumping, a drivehead at the surface applies rotational torque to rod string 111, which in turn causes downhole rotor 170 to rotate relative to stator 120 and tag insert 250.

In the embodiment shown in FIG. 4, no-go tag assembly 200 is used in conjunction with stator 120, which is hung from the lower end of production tubing 110. However, embodiments of the no-go tag assembly described herein (e.g., no-go tag assembly 200, 400) may also be employed in insertable progressive cavity pumps. As is known in the art, insertable progressive cavity pumps are positioned within a tubing string and are lowered downhole through the tubing string to the desired depth. In other words, insertable progressive cavity pumps are not hung from the lower end of the tubing string and are not delivered downhole by the tubing string. Examples of insertable progressive cavity pumps are disclosed in U.S. patent application Ser. No. 12/237,511 filed Sep. 25, 2008 and entitled "Insertable Progressive Cavity Pump," which is hereby incorporated herein by reference in its entirety.

Figure 15:
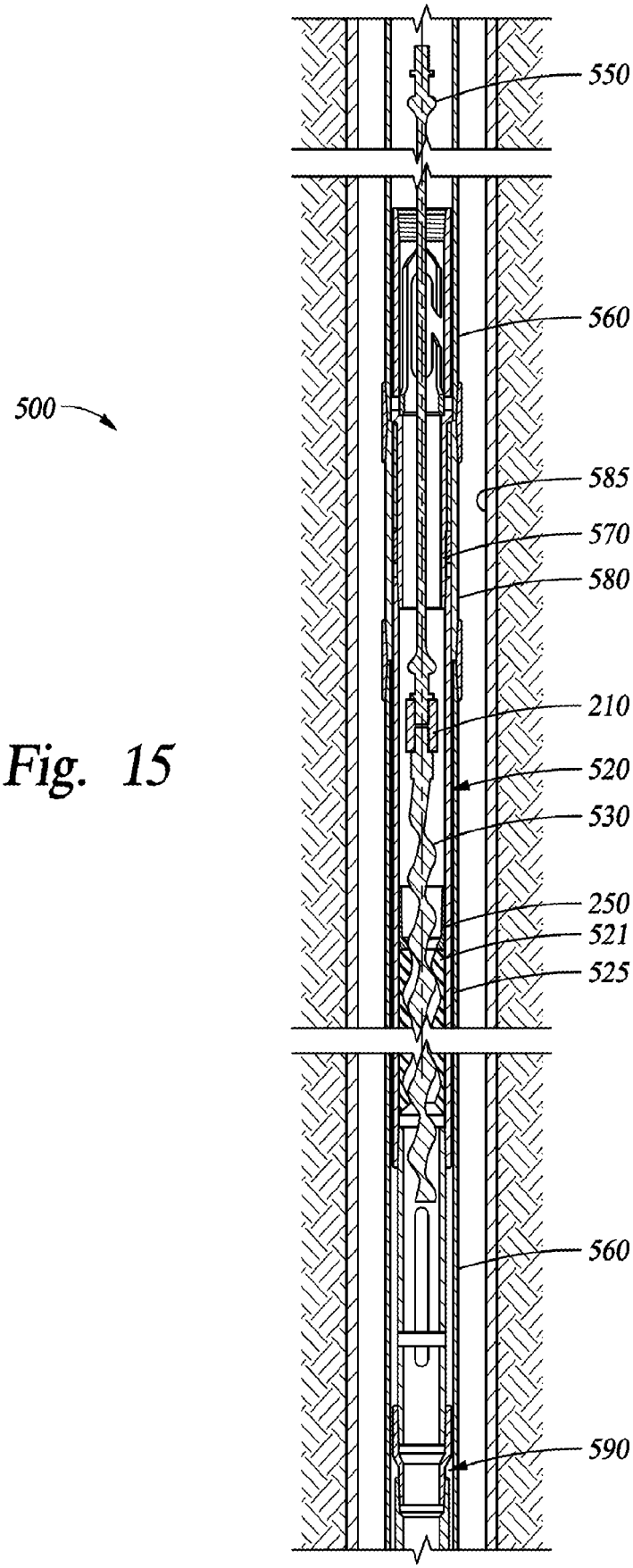
FIG. 15 is a cross-sectional view of an embodiment of an insertable progressive cavity pump system in accordance with the principles described herein disposed in a case wellbore.
Figure 16:
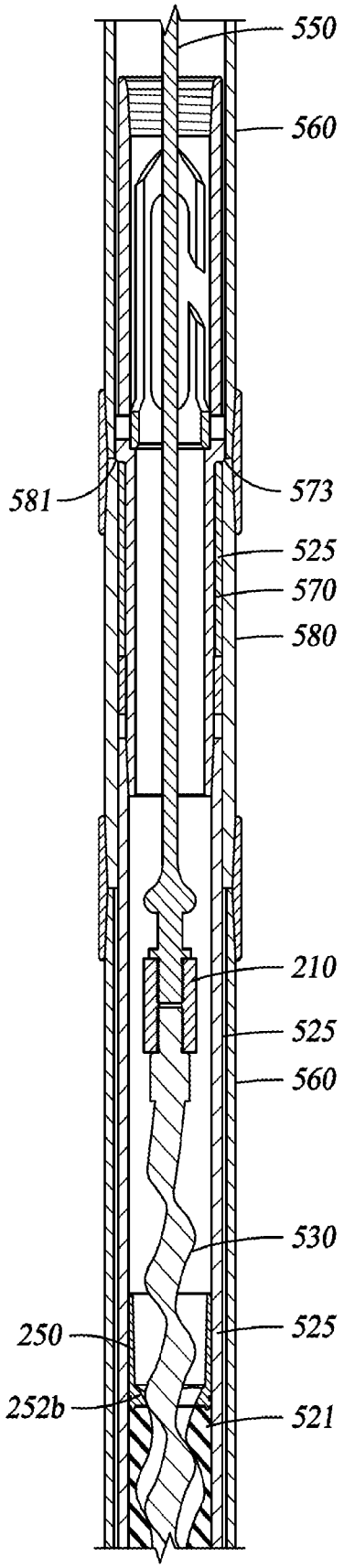
FIG. 16 is an enlarged cross-sectional view of the insertable progressive cavity pump of FIG. 15.

Referring now to FIGS. 15 and 16, an embodiment of an insertable progressive cavity pump 500 including no-go tag assembly 200 previously described is shown. PC pump system 500 comprises a stator 520, a rotor 530 disposed in stator 520, and a torque resisting device 590 coupled to the lower end of stator 520 and adapted to resist the rotation of stator 520 relative to production tubing string 560. Stator 520, rotor 530, tubing string 560, and cased wellbore 585 are coaxially arranged. As shown in FIGS. 15 and 16, unlike PC pump 100 previously described, PC pump system 500 is positioned "downhole" within production tubing string 560 disposed in cased wellbore 585, and is not delivered downhole on the end of tubing 560.

Stator 520 is similar to stator 120 previously described. Namely, stator 520 comprises a generally cylindrical radially outer housing 525 and a stator liner 521 having a helical-shaped inner surface adapted to mate with the helical-shaped outer surface of rotor 530. In addition, tag insert 250 previously described is disposed in housing 525 and engages the upper end of stator liner 521. However, in this embodiment, stator 520 also includes a seating mandrel 570 is coaxially coupled to the upper end of stator housing 525 with mating threads, thereby forming the upper end of stator 520. Seating mandrel 570 releasably and sealingly couples stator 520 to tubing string 560. In particular, seating mandrel 570 includes an annular shoulder 573 that engages a mating shoulder 581 of a seating nipple 580 disposed along tubing 560. Seating nipple 580 is preferably disposed at a predetermined depth in cased wellbore 585 suitable for production. When stator 520 is axially lowered into tubing string 560, seating mandrel 570 is free to advance through tubing string 560 until shoulders 573, 581 engage, thereby restricting seating mandrel 570 and stator 520 from continued axial advancement down tubing string 560.

Referring still to FIGS. 15 and 16, rotor 530 is the same as rotor 170 previously described. Rotor 530 is releasably coupled to the lower end of a rod string 550 with rotor coupling 210 previously described, and is delivered downhole to stator 520 via rod string 550. Specifically, rotor 530 is axially advanced through tubing string 560 and inserted into stator 520 until rotor coupling 210 contacts tag shoulder 252*b* of tag insert 250. Once rotor coupling 210 contacts tag shoulder 252*b*, rod string 550, including rotor 530 coupled thereto, is lifted axially upward a predetermined distance to account for stretching of sucker rod string 550, to prevent contact and interference between rotor coupling 210 and tag insert 250 during subsequent pumping operations, and to properly position rotor 530 within stator liner 521. In this embodiment, rotor coupling 210 is axially positioned above tag insert 250 when rotor 530 is properly positioned within stator liner 521 for pumping operation. Further, when properly positioned, rotor 530 extends axially below stator liner 521 and engages stator liner 521 along the entire axial length of stator liner 521. To begin pumping, a drivehead at the surface applies rotational torque to rod string 550, which in turn causes downhole rotor 530 to rotate relative to stator 520 and tag insert 250.

In the manner described, embodiments of no-go tag assemblies described herein (e.g., no-go tag assembly 200, 400, etc.) provide systems and methods for positioning a rotor (e.g., rotor 170) within a stator (e.g., stator 120) of a downhole PC pump (e.g., pump 100, 200, etc.). It should be appreciated that embodiments of no-go tag assemblies disclosed herein do not include a conventional tag bar or similar structure that extends radially across stator housing (e.g., housing 130) or stator liner (e.g., stator liner 140). Further, embodiments of no-go tag assemblies disclosed herein do not include any component or structure that obstructs the insertion of tools or instruments through the downhole stator to portions of the wellbore (e.g., wellbore 101) axially below the stator. In particular, with the rotor pulled from the stator and production tubing with the rod string, a tool or instrument may be axially inserted and advanced through the production tubing, through the downhole tag insert (e.g., tag insert 250), and through the stator liner to the portion of wellbore disposed axially below the downhole stator.

Although embodiments of the tag insert disclosed herein (e.g., tag insert 250) have been shown and described as a separate and distinct component that is releasably coupled to the stator housing (e.g., stator housing 130), in other embodiments, the tag insert and the stator housing may be distinct components that are permanently coupled (e.g., welded together, press fit together, etc.) or formed as a single, monolithic piece (e.g., cast or mold as a single piece, machined from a single piece of material etc.). Further, although embodiments of the no-go tag assemblies disclosed herein (e.g., no-go tag assemblies 200, 400) include a rotor coupling (e.g., rotor coupling 210, 410) releasably coupled to the lower end of the rod string to effectively increase the outer radius of the upper end of the rotor such that it will not pass completely through the tag insert (e.g., tag insert 250), in other embodiments, the upper end of the rotor may be sized sufficiently to eliminate the need for the rotor coupling. For example, in some embodiments, the upper end of the rotor may have an outer radius that is sufficiently large to prevent the upper end of the rotor from passing through the tag insert.

While preferred embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the invention. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims.

What is claimed is:

1. A progressive cavity pumping system for pumping a fluid from a wellbore, comprising:

a tubing string extending into the wellbore;

a stator coupled to the tubing string, wherein the stator has a central axis, an upper end, and a lower end opposite the upper end;

wherein the stator includes a stator housing and a stator liner disposed within the stator housing;

wherein the stator liner extends along the central axis from a first end proximal the upper end of the stator housing and a second end distal the upper end of the stator housing, and wherein the stator liner includes a helical passage extending from the first end of the stator liner to the second end of the stator liner;

a rod string extending through the tubing string;

a helical rotor extending axially into the through passage of the stator liner, wherein the rotor has a first end coupled to a lower end of the rod string and a second end distal the rod string; and a tag insert positioned in the stator housing between the upper end of the stator housing and the first end of the stator liner, wherein the tag insert comprises a through passage including a tag shoulder;

wherein the rotor extends axially through the passage of the tag insert, and wherein the tag shoulder is adapted to restrict the first end of the rotor from passing axially into the stator liner;

wherein the tag insert has a central axis coaxially aligned with the central axis of the stator housing, a first end proximal the first end of the stator housing and a second end proximal the first end of the stator liner, the through passage of the tag insert extending axially from the first end of the tag insert to the second end of the tag insert; and wherein the passage in the tag insert includes a helical portion axially positioned between the second end of the tag insert and the tag shoulder.

2. The pumping system of claim 1, further comprising a rotor sleeve extending between the first end of the rotor and the lower end of the rod string, wherein the rotor sleeve is disposed about the first end of the rotor, and wherein the tag shoulder is sized to prevent the rotor sleeve from passing axially therethrough.

3. The pumping system of claim 2, wherein the rotor sleeve has an outer radius $R_{rs}$;

wherein the tag insert has a central axis coaxially aligned with the central axis of the stator housing, a first end proximal the first end of the stator housing and a second end proximal the first end of the stator liner, the through passage of the tag insert extending axially from the first end of the tag insert to the second end of the tag insert;

wherein the tag shoulder of the tag insert comprises a frustoconical surface having a minimum radius $R_{fs}$ that is less than outer radius $R_{rs}$ of the rotor sleeve.

4. The pumping system of claim 1, wherein the tag insert has a radially outer cylindrical surface that slidingly engages a radially inner cylindrical surface of the stator housing.

5. The pumping system of claim 4, further comprising an annular seal radially positioned between the radially inner surface of the stator housing and the radially outer surface of the tag insert.

6. The pumping system of claim 4, wherein the stator liner has a radially outer surface that statically engages the stator housing and an end surface that extends radially from the helical passage of the stator liner to the radially outer surface of the stator liner at the first end, and wherein the end surface of the stator liner includes an annular groove that receives an annular ridge extending axially from the tag insert.

7. The pumping system of claim 1, wherein the helical portion of the tag insert mates with the helical rotor as the rotor is rotated within the through passage of the tag insert.

8. The pumping system of claim 1, wherein the stator is hung from a lower end of the tubing string or positioned within the tubing string.

9. The pumping system of claim 1, wherein the rotor has an axial length measured between the first end and the second end of the rotor that is greater than the axial distance between the tag shoulder and the second end of the stator liner.

10. The pumping system of claim 1, wherein the helical portion of the passage in the tag insert is timed to the helical passage of the stator liner.

11. A method for pumping fluid from a wellbore to the surface, comprising:

(a) providing a stator comprising a stator housing and a stator liner disposed within the stator housing, wherein the stator housing has a central axis, an upper end, and a lower end opposite the upper end, and the stator liner includes a helical through passage;

(b) positioning a tag insert in the stator housing between the stator liner and the upper end of the stator housing, wherein a through passage of the tag insert comprises a helical portion timed to the helical through passage of the stator liner;

(c) lowering the stator into a wellbore;

(d) lowering a rotor into a wellbore;

(e) axially advancing the rotor through the through passage of the tag insert and into the helical through passage of the stator liner downhole;

(f) using the tag insert to properly position the rotor within the stator liner; and (g) rotating the rotor within the stator liner with the rod string to pump a fluid to the surface.

12. The method of claim 11, wherein (f) further comprises restricting a portion of the rotor from passing into the stator liner with the tag insert.

13. The method of claim 12, wherein (f) further comprises engaging a rotor sleeve disposed about an upper end of the rotor with the tag insert.

14. The method of claim 13, wherein a lower end of the rotor extends axially from a lower end of the stator liner when the upper end of the rotor or the rotor sleeve engages the tag insert; and wherein the lower end of the rotor extends axially from the lower end of the stator liner during (g).

15. The method of claim 13, wherein (f) further comprises axially abutting a tag shoulder along the through passage of the tag insert with a lower end of a rotor sleeve coupled to an upper end of the rotor.

16. The method of claim 11, wherein (c) comprises coupling the upper end of the stator housing to a lower end of a tubing string and lowering the stator into the wellbore with the tubing string or lowering the stator into a tubing string disposed in the wellbore.

17. A stator for a progressive cavity pump, comprising:

a stator housing having a central axis, a first end, and a second end opposite the first end;

a stator liner disposed within the stator housing, wherein the stator liner has a first end and a second end opposite the first end, wherein the first end of the stator liner is axially spaced from the first end of the stator housing;

a tag insert positioned in the stator housing between the first end of the stator housing and the first end of the stator liner, wherein the tag insert has a through passage defining a radially inner surface that includes a tag shoulder;

wherein the through passage of the tag insert comprises a helical portion extending axially from the tag shoulder to a lower end of the tag insert, and wherein the helical portion is timed to the helical passage of the stator liner.

18. The stator of claim 17, wherein the tag insert has a radially outer cylindrical surface that slidingly engages a radially inner cylindrical surface of the stator housing.

19. The stator of claim 18, further comprising an annular seal element radially positioned between the tag insert and the stator housing.

* * * * *